United States Patent [19]

Rote

[11] 3,975,191

[45] Aug. 17, 1976

[54] METHOD OF PRODUCING CAST IRON

[76] Inventor: Franklin B. Rote, 5902 Rickfield - South, Jackson, Mich. 49203

[22] Filed: Nov. 25, 1974

[21] Appl. No.: 527,027

[52] U.S. Cl. ..... 75/130 R; 75/58; 75/130 A

[51] Int. Cl.[2] ..... C22C 33/08

[58] Field of Search ..... 75/58, 130 R, 130 A

[56] References Cited

UNITED STATES PATENTS 3,278,299 10/1966 Kessler ..... 75/130 R

*Primary Examiner*—Peter D. Rosenberg

*Attorney, Agent, or Firm*—Barnes, Kisselle, Raisch & Choate

[57] ABSTRACT

A method of producing cast iron wherein kish is added to either the molten iron or to the metal charge. Kish is graphite which floats to the surface of molten iron from a blast furnace. Each kish graphite flake has a very stable nucleus, predominately manganese sulfide, which initiates cell formation at or near the liquidus temperature when molten cast iron solidifies.

12 Claims, 3 Drawing Figures

METHOD OF PRODUCING CAST IRON

This invention relates to cast iron and, more particularly, to a method for controlling the castability and uniformity of gray, ductile and malleable irons.

Among the problems frequently encountered by iron foundries are nonuniformity of structure and mechanical properties, a strong tendency to shrink and crack, and, in the case of gray iron, an excessive chilling tendency.

These defects appear to be most pronounced in castings produced from metal melted in the electric furnace and made from metal charges of high scrap steel content. Cupola melted iron may, under ideal melting conditions, exhibit lesser tendency toward these defects, although they remain an important and costly problem. There is little than can be done by ladle treatment to reduce the severity of such defects in malleable iron, since corrective ladle treatment would produce mottle in the white iron castings. Ladle inoculation is employed in the production of gray and ductile iron to produce the desired graphitizing tendency upon solidification (reduction of chilling tendency), but this often leads to increased shrink and porosity. The latter is due to increase in solidification cell count which is produced as a secondary result of ladle inoculation. Inoculation with currently known materials, such as ferrosilicon, graphite, or combination proprietary inoculants, invariably leads to increased cell count.

The reasons for such defects can be best understood by a careful consideration of exactly what happens when molten iron solidifies. Solidification of cast iron begins when the metal has cooled from the pouring temperature to the liquidus solidification temperature. This temperature varies depending upon the composition of the iron. Unalloyed gray cast iron of typical automotive casting composition has a liquidus solidification temperature of 2120° – 2170° F. In higher carbon content ductile iron it is 2090° – 2100° F. In low carbon-low silicon iron (that is, malleable iron compositions) the liquidus solidification temperature may be as high as 2380° F. After the iron has cooled to the liquidus solidification temperature, the first solid is formed and continues to grow, changing the composition of the remaining liquid until the liquid reaches eutectic composition. The eutectic composition of cast iron is considered to be about 4.33% carbon equivalent. Carbon equivalent (C.E.) is expressed as:

$$C.E. = \% C + \tfrac{1}{3} (\% Si + \% P)$$

A hypereutectic iron is one in which the C.E. is greater than 4.33% and a hypoeutectic iron is one in which the C.E. is less than 4.33%.

When a hypereutectic gray or ductile iron is cooled, graphite or iron carbide is rejected from the molten mass until the molten remainder reaches the eutectic composition. Thereafter there is a simultaneous rejection at a substantially constant temperature of graphite or iron carbide and austenite. When a hypoeutectic iron cools the first solid rejected at the liquidus temperature is austenite. On further cooling from the liquidus to the eutectic temperature more austenite is precipitated and, when the remaining liquid reaches the eutectic composition, austenite and graphite or iron carbide are rejected simultaneously at a constant temperature.

Naturally, upon beginning of solidification of cast iron there is a period of time when the first solid metal particles form. These particles define a nucleus or base upon which additional solid metal can crystalize. As each particle forms and grows with the progress of solidification the amount of solid metal in the mass increases and the amount of liquid decreases. Eventually the solidifying particles reach a size where they begin to interfere with each other. Thereafter solidification is completed and the final solidification structure is established. Each individual particle which has grown in size and reaches interference with other particles defines a cell which is clearly identifiable in the microstructure of the casting.

In gray iron as cast the cell consists of a transistion product of austenite (that is, ferrite, pearlite, bainite, martensite or combinations thereof) plus graphite. In white iron the cell consists of a transistion product or products of austenite plus iron carbides. Depending upon the chilling tendency of the iron, it is possible to find both iron carbide and graphite in a solidification cell.

Castings having uniformity of structure and physical properties are produced in accordance with the above described phenomena of solidification only under ideal conditions where solidification begins at a temperature slightly below the equilibrium liquidus solidification temperature. However, as a practicel matter, in thin section castings solidification does not normally begin at or near the true liquidus temperature, but at a much lower temperature. This is due primarily to the process of undercooling which occurs, which causes the metal to cool below the true solidification temperature in order to permit the formation of stable metal nuclei upon which solidification can progress. When molten metal undercools substantially many nuclei are formed and grow with continued cooling. This results in a casting with many small cells. As the metal approaches complete solidification the many fine cells create severe restriction to movement of the remaining liquid metal to feed solidification shrinkage. As a result, porosity, tears or severe internal strains occur.

Castings with thick metal sections which cool slowly may solidify at close to equilibrium temperature. Only a few stable solid nuclei are formed and these form large cells upon completion of solidification. The resultant casting structure is coarse and "open grained", producing low mechanical properties. Thus, castings with combinations of thin and thick metal sections suffer widely different solidification temperatures, cell size, microstructure and mechanical properties. This leads to casting defects such as porosity, shrink and tears and widely variant mechanical properties.

The consequences of the lack of structural uniformity in castings are many. For example, because of different temperatures and different rates of solidification, thin and thick metal sections of a casting tend to reach the critical degree of solidification, when only a small amount of the eutectic liquid remains, at different times. This often leads to surface draws or shrinks, particularly at the reentrant corners of the casting or at the intersection of thick and thin sections. In addition, sections with small cell size may have internal porosity because of their inability to secure feed liquid metal at the final stages of solidification. Furthermore, the difference in structure and cell size between different sections of a casting may lead to dimensional inaccuracy in the component machined therefrom. Finally, the lack of structural uniformity results in different mechanical properties from section to section of the casting.

The object of the present invention is to minimize the above-mentioned casting defects by promoting the solidification of molten iron with a uniform controlled cell size and graphite structure.

In accordance with the present invention this is accomplished by incorporating, either in the metal charge or in the pouring ladle, a material containing a refractory nucleus which promotes cell formation at a temperature which is only slightly below the true liquidus temperature. More specifically, the present invention contemplates the addition of kish to the iron.

The material referred to herein as "kish" is universally understood in foundry practice to consist of the graphite that is expelled from blast furnace hot metal at all stages of handling from the time it is tapped from the blast furnace until it has solidified into pigs or has been diluted or refined in the steel making process. As used herein the term "kish" designates essentially air-born flake graphite formed from hypereutectic blast furnace hot metal. Currently it is a troublesome and yet inevitable by-product of blast furnace operation which must be collected and disposed of at substantial expense.

When kish is used as an additive for gray, ductile or malleable iron it results in a large improvement in properties. Fluidity of the iron is increased, non-uniformity of structure is minimized and the tendency to shrink, crack or chill is reduced. The cell size is larger or coarser in thin sections and sections of moderate thickness than in an iron of the same composition produced without kish or without pig iron. Cell size in thick sections is decreased.

It is believed that the improved properties imparted to the iron when kish is added can be explained by a careful examination of kish graphite. I have found that each particle of kish graphite contains a nucleus of a ceramic material. The nucleus appears to vary in weight from about 5 – 30% of the total weight of the flake. Analysis of several samples of kish shows a manganese content of about 0.5 – 1.5% and a sulfur content of about 0.3 – 1%. These are the correct proportions of manganese to sulfur (about 1.7 to 1) for the formation of manganese sulfide which leads me to believe that the nucleus of a kish graphite particle is predominately manganese sulfide combined with other refractory materials. Kish from various blast furnaces varies in composition, but, regardless of the source, it appears to perform at about the same effectiveness.

It is believed that the superior qualities of cast iron formed with kish are directly attributable to the nucleus of the kish graphite particle. The nucleus, which is not carbon and which is formed from blast furnace metal, must, of necessity, be a very refractory substance. This is true because the nucleus is formed in superheated iron (that is, at a temperature at or considerably above about 2700° F.) After this refractory nucleus is formed carbon deposits on it, which produces a flake. This flake then floats to the top of the molten stream or ladle, becomes airborne and is collected for disposal. When added to a gray or malleable iron charge or in the pouring ladle the carbon component of the kish is dissolved in the molten iron. This produces a reduced chilling tendency. However, the nucleus being highly refractory (a solid at about 2700° F.) remains in suspension in the molten cast iron at superheat temperatures of about 2700° – 2850° F. Accordingly, upon solidification of the iron this nucleus is available at liquidus solidification to initiate cell formation. With such nuclei present it is not necessary for considerable undercooling to occur in thin metal sections in order to initiate cell formation, as is the case with an iron devoid of such available nuclei. Consequently, cells begin to form at a higher temperature and upon fewer nuclei and graphite formation is promoted. As a result, a coarser cell and graphite size results. Thick metal sections which would normally solidify at close to the equilibrium liquidus temperature upon few nuclei to form large cell size are provided with available nuclei from the kish and, thus, produce more cells of smaller size, approaching the size in thinner section castings. Graphite flake size, in the case of gray iron, is smaller. This produces substantially greater uniformity in cell size between thick and thin metal sections and results in the elimination or the minimizing of the casting defects previously described. In gray iron and ductile iron graphite flake or nodule size is more uniform.

In castings having metal section thickness varying from thick to thin, the function of kish is particularly important. Without kish the thicker sections cool slowly; they do not undercool substantially and, thus, have a relatively coarse cell and graphite flake size. However, as pointed out previously, thinner sections undercool substantially; they form many nuclei and develop a small cell size with fine graphite. This accounts for the non-uniformity of structure and physical properties of such castings. With the use of kish graphite these differences are minimized. The available nuclei provided by the kish graphite have a very desirable effect on both thick and thin sections of the casting. In thick sections the residual kish nuclei initiate solidification at more sites, thus actually reducing the cell size and the graphite size. However, in thinner sections the nuclei initiate solidification at a high temperature, thus increasing the cell size, improving the graphite distribution and developing larger graphite flake size.

When used in malleable iron which must solidify free of graphite, lesser controlled amounts of kish are used. Kish nuclei initiate liquid solidification and produce uniformity of cell size, thus controlling serious solidification defects. They also act as nuclei for formation of temper carbon graphite during the first stage annealing at 1600° – 1800° F., thus producing a more uniform graphite structure in the annealed casting. The rate of first stage annealing is increased as a consequence of their presence.

Ladle inoculants of the proprietary types provide abundant graphite nuclei which promote graphite flake formation in thinner sections. However, such inoculants at the same time produce a very fine cell size. Thus, the use of kish graphite produces the beneficial effects of ladle inoculants, but avoids producing the adverse effects thereof.

In accordance with the present invention kish may be used in the metal charge or as a ladle addition. It may be used in the flake form or processed for ease of handling. It can be briquetted by compaction to form pellets or slugs, or bonded with cement. Kish can also be added to the ground coal mixture used to produce metallurgical coke, particularly for cupola melting of iron. In the latter case the carbonaceous component of kish would provide part of the fixed carbon content of the coke. The kish nuclei are unchanged during coking and are available for control of graphite and cell size in the cupola melting iron. Since the amount of coke consumed in melting and superheating iron in a cupola can vary between 10 – 20% by the weight of the iron melted and, since up to about 75% of the nuclei provided by the kish could be slagged off during melting, the amount of kish added to the ground coal mixture itself would be in the range of about 2 – 20%. The smaller percentage would be used in making coke for melting malleable iron and larger amounts used for melting gray cast iron.

In determining the amount of kish to be used in the production of specific castings several factors must be taken into account, such as the components of the metal charge, the method of melting, the method of adding the kish and the type of cast iron being produced. With respect to the components of the metal charge, small additions of kish are used if the charge contains large amounts of graphitic material such as pig iron and gates, risers and scrap of gray iron, nodular iron or annealed malleable iron. These materials would provide some of the desired nuclei so that a relatively small amount of kish is required to develop the optimum solidification characteristics. With such charges kish can be added in amounts of between 0.10% to about 0.50% in the charge. When the metal charge contains a large percentage of steel scrap and little graphitic material, 0.5 – 4% kish may be added to the charge to develop the required cell control.

The method of melting also determines the amount of kish required to produce the desired uniformity and cell size. In the production of a particular iron of fixed metal charge the amount of kish in the charge is desirably varied according to the method of melting. Melting in a cupola requires the least kish, an electric induction furnace more, and an electric arc furnace the most. These variations are required because the difference in melting conditions and methods result in differing amounts of nucleus loss during melting. Thus, if a particular metal charge requires about 0.25 – 0.50% kish for cupola melting, melting in an induction furnace would require about 0.50 – 1% kish and melting of the same charge in an electric arc furnace might require 0.75 – 1.5% kish. Obviously with a high percentage of steel in the charge the amount of kish required would be greater.

The manner in which the kish is added to the iron also determines the amount of kish required to produce the desired properties. Less kish is used in ladle additions than when the kish is added to the metal charge itself. This results from the fact that kish acts as a mild inoculant when added to the ladle. It also acts to control cell size regardless of whether it is added to the ladle, to the charge, or as part of the coke makeup. A ladle addition would normally be in the range of about 0.05 – 0.50%. When kish is added to the charge it may be used in an amount as high as 4%, particularly in the case of an electric arc furnace. Kish may be used to provide all of the carbon in the iron to achieve the desired carbon content or in a lesser amount simple to control cell size with some other carbon source to provide the remainder of the carbon required.

Kish may be also mixed with conventional inoculant materials, such as ferro silicon or other proprietary alloys for ladle addition. The combination of kish with a conventional inoculant provides high graphitizing power for thin section castings. However, the presence of kish nuclei promotes the early formation of cells and graphite during solidification. Thus, when kish is used in this manner it produces a coarser cell size and simultaneously overcomes an undesirable feature of conventional inoculants.

In the following examples the effects of kish additions for various types of iron castings are set forth:

EXAMPLE I

The composition specified for a conventional automotive camshaft is as follows:

| | |
|---|---|
| Total carbon | 3.30 – 3.50% |
| Silicon | 2.20 – 2.40% |
| Manganese | .70 – .80% |
| Sulfur | .12% max. |
| Chromium | 1.20 – 1.40% |
| Molybdenum | .40 – .60% |
| Nickel or Copper | .20 – .40% |

The specified microstructure of the lobe on the camshaft as cast consists of 10 – 20% primary iron carbide, graphite and pearlite. The composition and melting practice must be adjusted to develop the desired lobe microstructure, but at the same time produce a machinable hardness in the bearing and gear portions of the camshaft of 262 – 311 Brinell. Frequently castings produced with the desired lobe microstructure and bearing hardness of 285 Brinell or higher must be scrapped because the surface draws or internal shrink at the junction of the gear and shaft protions. For example, a melt was made with an arc furnace melting charge consisting of:

| | |
|---|---|
| 800 lbs. | Steel |
| 1000 lbs. | Return gates and risers |
| 1200 lbs. | Cast iron scrap |
| 60 lbs. | Flake graphite |
| 4 lbs. | Ferro manganese |
| 20 lbs. | Ferro silicon |
| 16 lbs. | Ferro molybdenum |
| 34 lbs. | Ferro chromium |
| 8 lbs. | Copper |

The composition of the metal produced was: 3.45 T.C., 2.39 Si, 0.78 Mn, 1.40 Cr, 0.32 Mo, 0.24 Cu, and 0.085 S. The lobes had the desired structure, and bearing hardness was 285 Brinell. All castings poured were scrapped because of severe shrink between bearings and shaft. Some actually tore apart during solidification and cooling.

A second melt was produced wherein 20 pounds of flake graphite were replaced by 24 pounds of kish with all other components remaining the same. This produced a composition of 3.42 T.C., 2.37 Si, 0.75 Mn, 1.38 Cr, 0.36 Mo, 0.29 Cu, and 0.09 S. The microstructure was excellent and hardness was 302 Brinell. There was no evidence of shrink or draw. The cell diameter of the first melt was about 50% as large as in the second heat. In this case the amount of kish used in the charge was kept at a relatively low level to avoid having a large number of residual nuclei which could reduce the amount of carbide present in the lobe.

EXAMPLE II

A bicycle frame support which includes the sprocket tube and the frame supports radiating therefrom is often made as a malleable iron casting. Production castings for such parts were made from a charge consisting of:

| | |
|---|---|
| 53% | Steel Scrap |
| 40% | White Iron Gates and Risers |
| 5% | Malleablized Scrap |

-continued

| | |
|---|---|
| 2% | Flake Graphite |

The metal target analysis was: 2.50 – 2.60% T.C., 1.50 – 1.60% Si, 0.30 – 0.35% Mn, 0.03 – 0.05% S. The metal was melted in a 13 ton capacity coreless induction furnace. In production, it was necessary to repair 50 – 95% of the castings, depending on day to day variations in melting practice, for shrinks (draws) at intersection of main sprocket tube and frame supports.

In a test melt using kish as a replacement for part of the graphite in the above specified charge, the graphite addition was reduced to 1.5% and 0.6% kish was added. Of the 1,000 pieces produced, all but five were free of any indication of shrinks and draw.

The dendrite size of the white iron castings containing kish in the charge was coarser and more uniform than in the standard production melt. This resulted from nucleation by the kish nuclei at a higher temperature than normal for the production iron. The kish addition was kept relatively low to preserve the required white iron structure as cast. The castings had the following analysis: 2.46% T.C., 1.53% Si, 0.33% Mn, and 0.05% S.

EXAMPLE III

A group of hydraulic pump bodies, each weighing about 49 pounds and with sections ranging from 2½ to ½ inch in thickness, was produced as gray iron with a specified tensile strength of 40,000 pounds per square inch. The nominal composition was: 2.90 – 3.10% T.C., 1.90 – 2.10% Si, 0.60 – 0.70% Mn, 0.10 – 0.20% Cr, and 0.05 – 0.08% S. The metal was melted in a 7 ton capacity coreless induction furnace with a charge consisting of:

| | |
|---|---|
| 40% | Steel |
| 40% | Return gates and risers |
| 20% | Cast scrap |
| 1.2% | Flake graphite |
| .15% | Ferro chromium (70% Cr) |

The castings varied in hardness from 241 Brinell in the ½ inch section down to 163 Brinell in the 2½ inch section. The cell size in the heavy sections was very coarse and in the thin section very fine. Many castings had shrinks and tears at the intersection of the thin and thick sections.

A test melt was poured wherein all of the charge components remained the same, except that 1% flake graphite was substituted by 1.2% kish. This resulted in castings with a hardness of 217 Brinell in thin sections and 197 Brinell in thick Sections. The cell size in the thick sections was reduced and in the thin sections increased as compared with the production castings. There was no evidence of shrinks or draws. The metal composition of the castings produced by the test melt was: 3.08% T.C., 2.07% Si, 0.67% Mn, 0.17% Cr, and 0.07% S.

EXAMPLE IV

A group of 380 pound, 6-cylinder engine blocks was produced of cupola melted gray iron. The casting had the following composition: 3.20 – 3.40% T.C., 2.20 – 2.40% Si, 0.70 – 0.80% Mn, and 0.15% S max. The metal was tapped from the cupola into a heated receiver and then poured into a pouring ladle. During the transfer from the receiver to the pouring ladle an addition of 0.25% of a ferro silicon inoculant was made to the stream. The inoculant was required to insure freedom from chill in thin sections and at the edges of the cylinder block. Up to about 30% of the cylinder blocks so produced required salvage or were scrapped because of internal shrinks. The castings had a fine cell size.

When the practice was modified by substituting 0.15% kish graphite for the ferro silicon inoculant, the internal porosity resulting from shrinkage was eliminated and the castings were free from chill in the thin sections and at the edges. The cell size was about 75% coarser than in the production metal. The metal composition was: 3.35% T.C., 2.33% Si, 0.72% Mn, and 0.11% S.

In order to further illustrate the nature of kish graphite and the effects of kish additions to cast irons, reference is had to the drawing in which.

Figure 1:
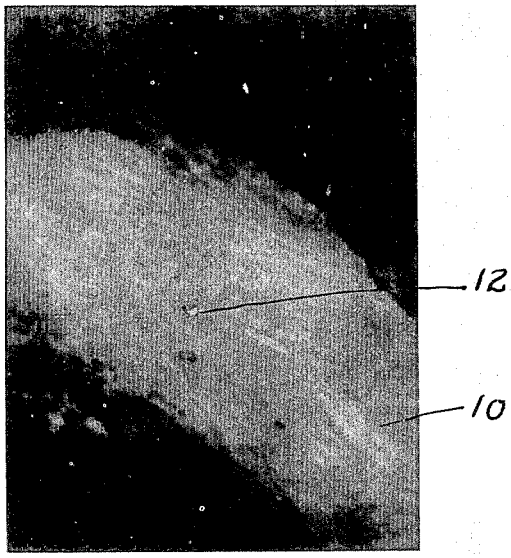
FIG. 1 is a photomicrograph at 800 magnifications of a kish graphite flake.

Referring to FIG. 1, the graphite flake itself is the large fuzzy light area designated 10 and the nucleus is the small angular light colored particle 12 in the middle of the flake.

Figure 2:
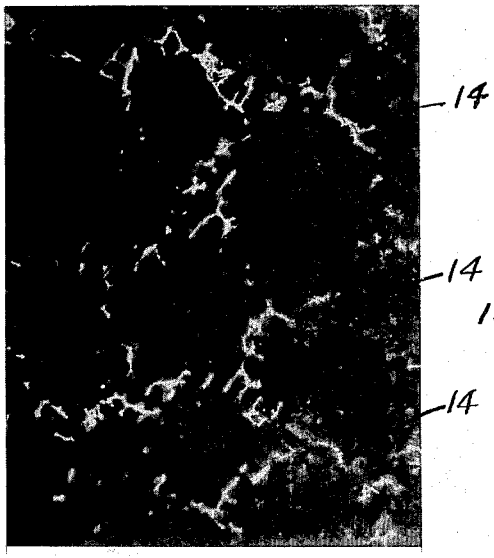
FIG. 2 is a photomicrograph at 80 magnifications of an alloyed iron melted in an electric arc furnace with no kish addition.
Figure 3:
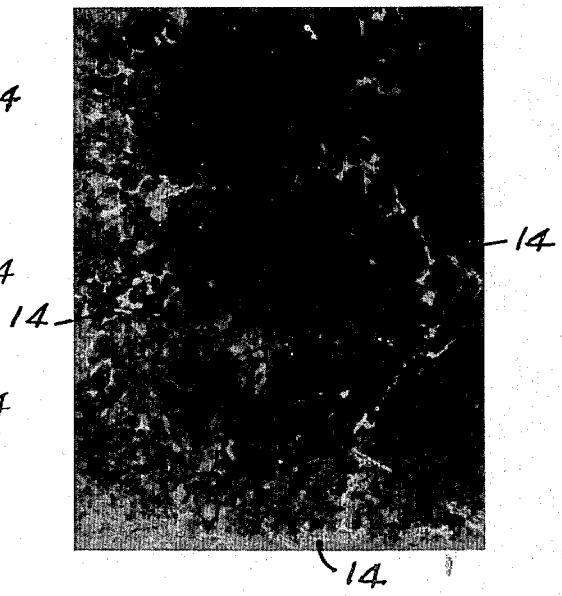
FIG. 3 is a phtotomicrograph at 80 magnifications of the same alloyed iron shown in FIG. 2, but with 0.8% kish in the charge.

FIGS. 2 and 3 are magnified 80 diameters to illustrate the different cell sizes obtained with the two irons described in Example I above; FIG. 2 shows a section of the production iron without kish and FIG. 3 shows the same section of the iron according to the present invention wherein 20 pounds of flake graphite were replaced by 24 pounds of kish. The difference in cell sizes in these two irons is clearly evident because the iron carbides designated 14 precipitated in the cell boundaries, thus making the identificaton of the cell size readily apparent.

I claim:

1. In the method of producing cast iron wherein a metal charge is melted in a furnace and the molten iron is poured into a mold to produce an iron casting, the step of adding kish to the metal in an amount of between 0.05 and 4.0% by weight before the metal is poured into the mold.

2. The method of claim 1 wherein the kish is added to the metal charge.

3. The method of claim 1 wherein the kish is added to the molten iron.

4. The method of claim 3 wherein the iron is transferred from the melting furnace to a pouring ladle and the kish is added to the ladle in an amount of about 0.05 to 0.5%.

5. The method of claim 4 wherein the kish is mixed with a ladle inoculant before adding it to the pouring ladle.

6. The method of claim 1 wherein the casting produced has sections which vary in thickness from as thin as one-half inch to as thick as two and one-half inches.

7. The method of claim 1 wherein said material is contained in a carbonaceous carrier.

8. In the method of producing cast iron wherein a metal charge is melted in a furnace and the molten iron is poured into a mold to produce an iron casting, the step of adding to the metal before it is poured into the mold a quantity of refractory nucleii of microscopic size which melt at a temperature in excess of about 2,700°F.

9. The method of producing cast iron by heating a metal charge and metallurgical coke in a cupola which includes the step of obtaining at least a portion of the desired carbon content of the iron by incorporating kish in a ground coal mixture to produce the coke.

10. The method of claim 1 wherein the iron is melted in an electric furnace and kish is added to the metal charge in an amount of between 0.2 to 4.0% of the charge.

11. The method of claim 1 wherein the iron is melted in a cupola and kish is added to the metal charge in an amount of between 0.2 to 0.50% of the charge.

12. The method called for in claim 9 wherein kish is incorporated in the ground coal mixture in an amount of between 2 to 20% by weight.

* * * * *

UNITED STATES PATENT OFFICE

CERTIFICATE OF CORRECTION

PATENT NO. : 3,975,191

DATED : August 17, 1976

INVENTOR(S) : Franklin B. ROTE

It is certified that error appears in the above-identified patent and that said Letters Patent are hereby corrected as shown below:

Column 8, Line 63 Cancel "1" and insert -- 8 --

Signed and Sealed this

Seventh Day of June 1977

[SEAL]

*Attest:*

RUTH C. MASON
*Attesting Officer*

C. MARSHALL DANN
*Commissioner of Patents and Trademarks*